US007048634B1

(12) United States Patent
Fernandez et al.

(10) Patent No.: US 7,048,634 B1
(45) Date of Patent: May 23, 2006

(54) SKATEBOARD RAIL

(76) Inventors: Alexander H. Fernandez, 124 15th St., #B, Huntington Beach, CA (US) 92648; Mario M. Sanchez-Laky, 454 Martelo Ave., Pasadena, CA (US) 91107

( * ) Notice: Subject to any disclaimer, the term of this patent is extended or adjusted under 35 U.S.C. 154(b) by 20 days.

(21) Appl. No.: 10/895,298

(22) Filed: Jul. 19, 2004

(51) Int. Cl.
*A63C 19/10* (2006.01)

(52) U.S. Cl. ..... 472/89

(58) Field of Classification Search ..... 472/88–90; 482/70, 71; 14/69.5, 71, 74; 256/59, 65.15; 434/247, 253

See application file for complete search history.

(56) References Cited

U.S. PATENT DOCUMENTS

| | | | | |
|---|---|---|---|---|
| 2,436,467 | A * | 2/1948 | Winter | 414/537 |
| 3,363,583 | A * | 1/1968 | Greenberg | 104/134 |
| 4,285,514 | A * | 8/1981 | Romero | 472/89 |
| 5,599,235 | A * | 2/1997 | Lynberg | 472/89 |
| 5,718,412 | A * | 2/1998 | Levanas | 256/1 |
| 6,389,629 | B1 * | 5/2002 | Schouest | 14/69.5 |
| 6,526,614 | B1 * | 3/2003 | Anderson et al. | 14/69.5 |
| 2002/0050589 | A1 * | 5/2002 | Nestel | 256/67 |

* cited by examiner

*Primary Examiner*—Kien Nguyen
(74) *Attorney, Agent, or Firm*—Jack C. Munro

(57) ABSTRACT

A skateboard rail which is composed of a plurality of members which are to be connected together in an end-to-end relationship. The members are capable of being pivoted relative to each other. The members are capable of being stacked vertically and also are connectable together side-by-side to form an expanded horizontal rail.

12 Claims, 7 Drawing Sheets

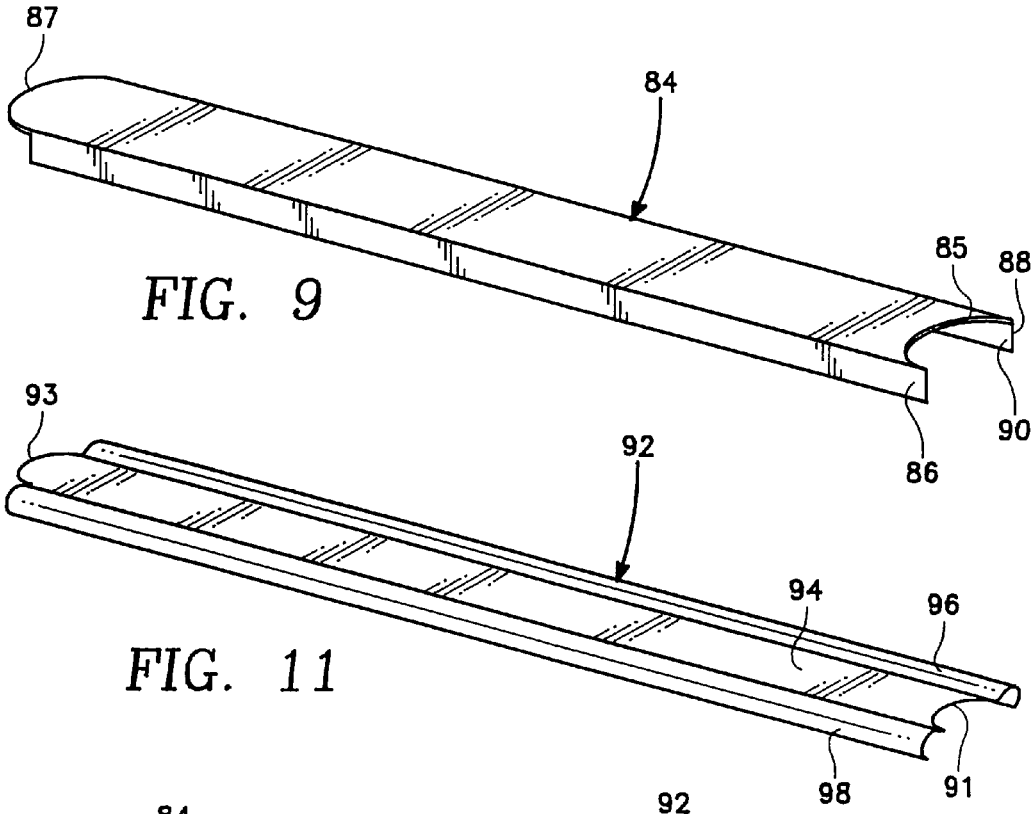
FIG. 9
FIG. 11
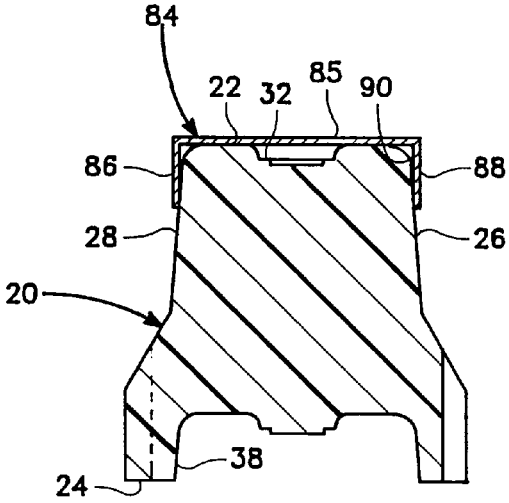
FIG. 10
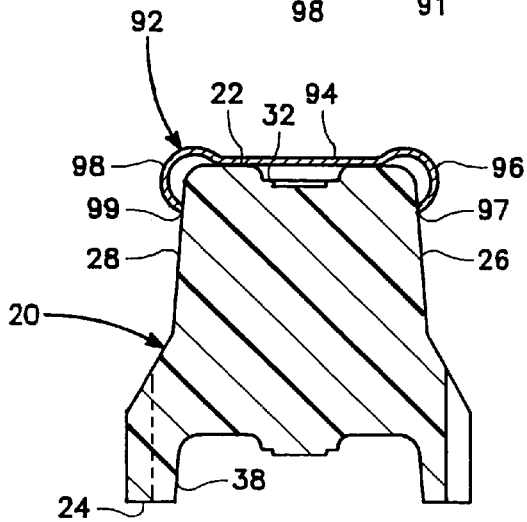
FIG. 12

SKATEBOARD RAIL

BACKGROUND OF THE INVENTION

1. Field of the Invention

The subject matter of this invention relates to a skateboard rail which is to be utilized in the sport of skateboarding where a skateboarder can maneuver the skateboard up off a supporting surface onto the rail and slide along the rail.

2. Description of the Related Art

Skateboarders maneuver skateboards in a variety of ways and not necessarily on a supporting surface, such as a flat cement or asphalt surface or a half-round tube. Proficient skateboarders are capable of hopping off of a supporting surface onto a handrail located next to a series of steps and slide down the handrail. This proficiency has led to the development of a skateboard rail.

A prior art skateboard rail typically is constructed of a rail member which is designed to be placed in conjunction with a supporting surface. The rail member is a single elongated member that may be five or seven feet in length and it sticks up from the supporting surface generally no more than about one to two feet. It would be desirable to improve on the prior art form of skateboard rail so that the skateboard rail can be made to be substantially longer in length, higher, wider and can be contorted into different directions rather than just being in a single direction.

SUMMARY OF THE INVENTION

A first basic embodiment of skateboard rail of this invention which is composed of a plurality of members which are connected together by a connecting means in an end-to-end relationship where each member of the members is elongated having a longitudinal axis.

A further embodiment of the present invention is where the first basic embodiment is modified by having each member movable relative to a member to which it is connected.

A further embodiment of the present invention is where the first basic embodiment is modified by each member having a top surface and a bottom surface which are connected together by sides so that the skateboard rail in transverse cross-section has a general rectangular configuration.

A further embodiment of the present invention is where the just previous embodiment is modified by the members also being connected together side-to-side by side connection means.

A further embodiment of the present invention is where the just previous embodiment is modified by the side connection means being defined as a dovetail slot assembly.

A further embodiment of the present invention is where a previous embodiment is modified by the top surface including an elongated channel which is adapted to be connected to a leg of a separate table which can be utilized in conjunction with the skateboard rail of the present invention.

A further embodiment of the present invention is where a previous embodiment is modified by the bottom surface being defined as being an elongated deep cavity that permits insertion of a top surface of another member in an interlocked relationship to form a stack of the members.

A further embodiment of the present invention is where the just previous embodiment is modified by when the members are in the stack the members are longitudinally locked together by a plurality of projections that engage with a plurality of cavities which prevent longitudinal relative movement between the members.

A further embodiment of the present invention is where the first basic embodiment is modified by there being included a connector composed of a pair of elements which are pivotally connected together at a pivot axis, this connector is to be connected in an end-to-end relationship to the connecting means of the skateboard rail.

A further embodiment of the present invention is where the first basic embodiment is modified by defining that the connecting means comprises a pin and hole connection.

A further embodiment of the present invention is where a previous embodiment is modified by the pivot axis being located transverse to the longitudinal axis.

A second basic embodiment of the present invention relates to a skateboard rail segment which is defined as an elongated member having a top surface and a bottom surface which are connected together by opposing sides. The elongated member terminates in a pair of ends defined as a front end and a rear end with the front end having a first connecting means and the rear end having a second connecting means. The bottom surface of the elongated member is to be placed on a supporting surface so a skateboarder can hop onto that elongated surface and slide by a skateboard along the top surface.

A further embodiment of the present invention is where the second basic embodiment is modified by there being included an elongated shallow channel within the top surface.

A further embodiment of the present invention is where the second basic embodiment is modified by there being included an elongated deep cavity within the bottom surface.

A further embodiment of the present invention is where the second basic embodiment is modified by each of the sides having a means for interlocking with another elongated member.

A further embodiment of the present invention is where the just previous embodiment is modified by the means for interlocking being defined as a dovetail slot assembly.

A further embodiment of the present invention is where the second basic embodiment is modified by the elongated shallow channel being defined as having a first engagement means and the elongated deep cavity being defined as a second engagement means where the second engagement means and the first engagement means are connectable together when a pair of the elongated members are located in a stacked relationship.

A further embodiment of the present invention is where the just previous embodiment is modified by defining the first engagement means as comprising a plurality of spaced apart cavities.

A further embodiment of the present invention is where the just previous basic embodiment is modified by the second engagement means comprising a plurality of spaced apart projections which are adapted to interlock with the cavities.

A further embodiment of the present invention is where the second basic embodiment is modified by the bottom surface being defined as being wider than the top surface.

A further embodiment of the present invention is where the second basic embodiment is modified by there being included a protective cover attachable onto the elongated member covering the top surface.

A further embodiment of the present invention is where the just previous embodiment is modified by the protective cover being defined as including coping bumps at each side of the cover.

A further embodiment of the present invention is where the second basic embodiment is modified by the bottom surface including a series of sawteeth to provide a roughened surface which can be used to prevent slippage of the elongated member when placed against a supporting surface.

BRIEF DESCRIPTION OF THE DRAWINGS

For a better understanding of the present invention, reference is to be made to the accompanying drawings. It is to be understood that the present invention is not limited to the precise arrangement shown in the drawings.

FIG. 9 is an isometric view of a first embodiment of cover that is to be usable with an elongated member of the skateboard rail of the present invention;

FIG. 10 is a cross-sectional view through an elongated member of the skateboard rail of the present invention showing the cover of FIG. 9 installed thereon;

FIG. 11 is an isometric view of a second embodiment of cover that is utilized in conjunction with the skateboard rail of the present invention;

FIG. 12 is a cross-sectional view showing the second embodiment of cover installed in conjunction with an elongated member of the skateboard rail of the present invention;

DETAILED DESCRIPTION OF THE INVENTION

Figure 1:
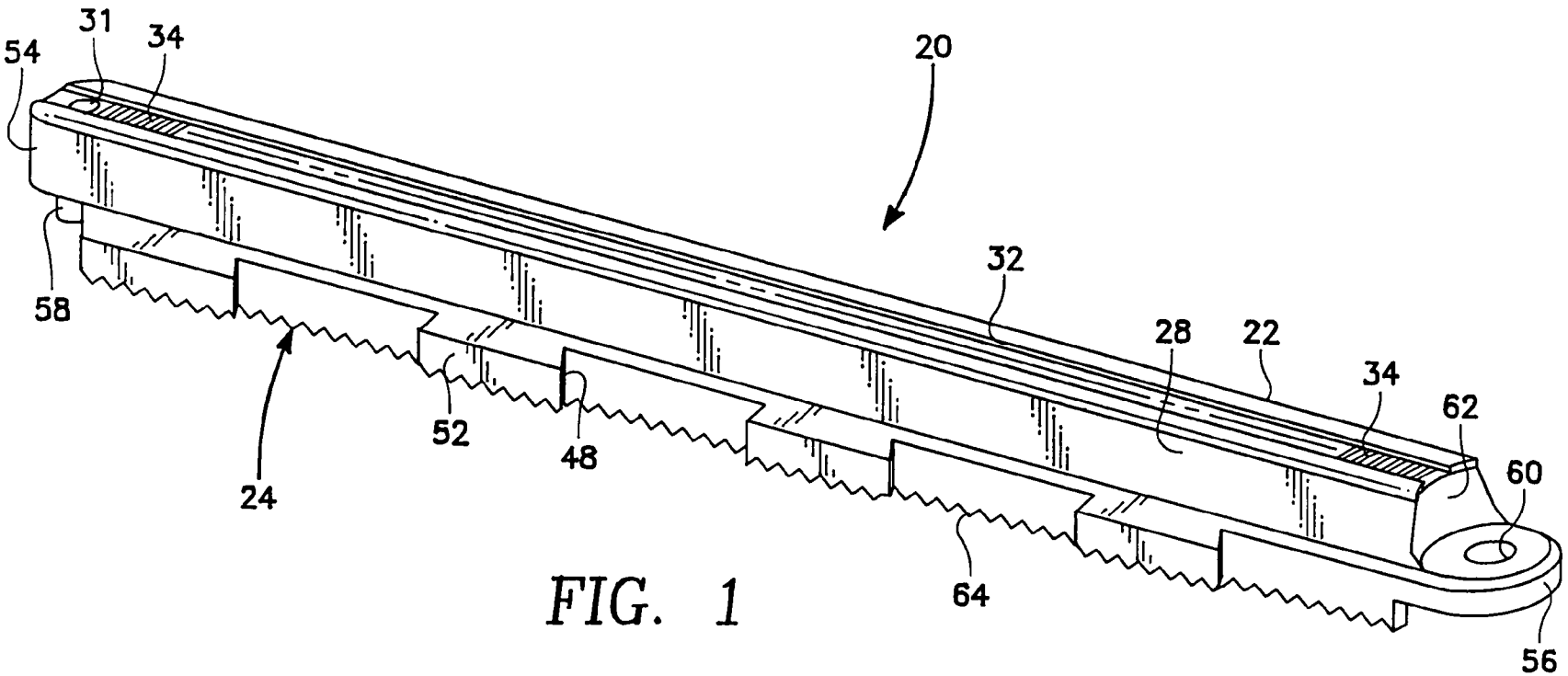
FIG. 1 is an exterior isometric view of the elongated member of the skateboard rail of the present invention.
Figure 2:
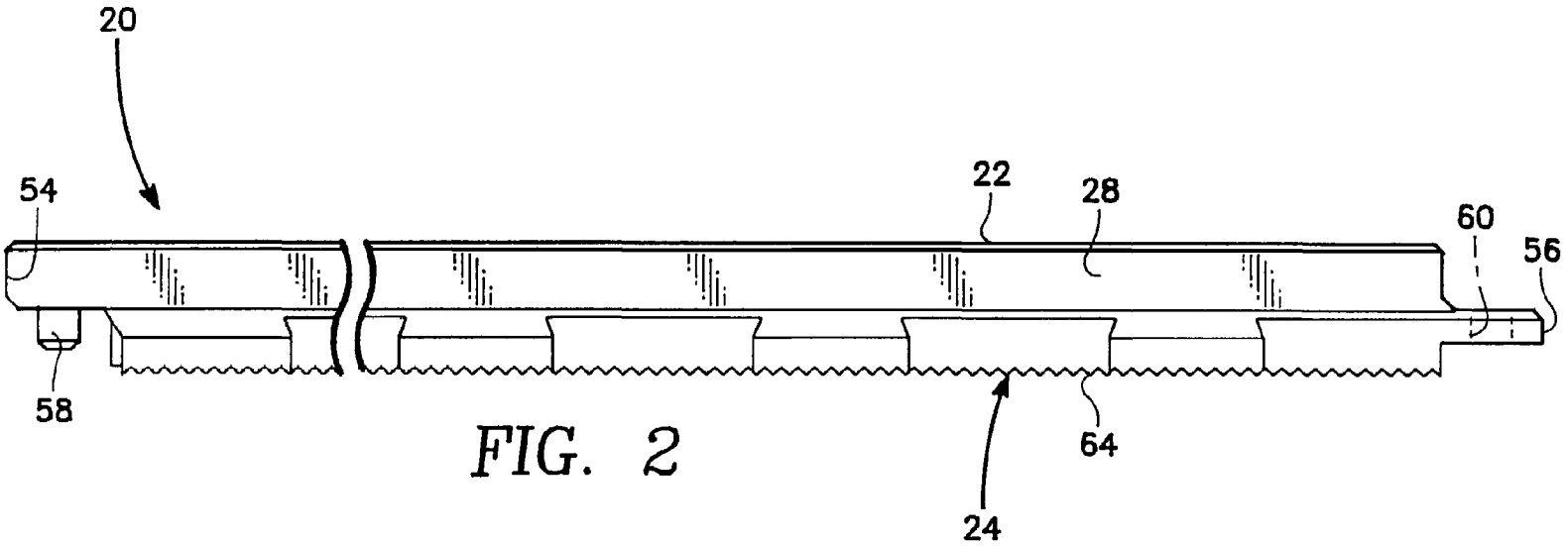
FIG. 2 is a side elevational view of the elongated member of the skateboard rail of the present invention.
Figure 3:
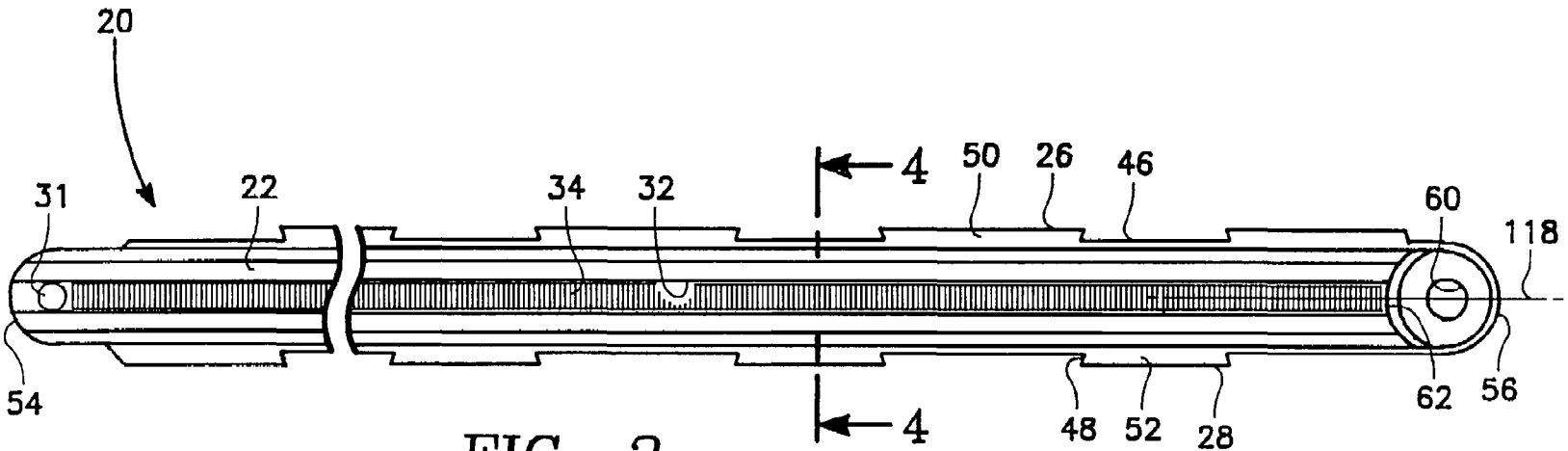
FIG. 3 is a top plan view of the elongated member of the skateboard rail of the present invention.

Referring particularly to FIGS. 1–4 of the drawings, there is shown a skateboard rail segment in the form of an elongated member 20 which is to be usable to form the skateboard rail of the present invention. The elongated member 20 would generally be in the range of six feet in length. The elongated member 20 has a top surface 22, a bottom surface 24, a right side 26 and a left side 28. The right side 26 is approximately parallel to the left side 28 so in transverse cross-section the general configuration of the elongated member 20 is that of a rectangle. However, the width of the elongated member 20 at the bottom surface 24 is substantially wider than the width of the top surface 22, which is readily apparent when observing FIG. 4. One reason for this is to increase the stability of the elongated rail when it is being used making it less likely to tip over. The elongated member 20 will generally be constructed of a plastic material and when fabricated will have a hollow internal cavity 30 in order to decrease the overall weight of the elongated member 20. Weighted material such as water, sand or shot can be inserted into cavity 30 by removing of cap 31 and pouring such in cavity 30. When cavity 30 is filled, cap 31 is to be replaced. This will add weight to the member 20 making it less likely to flip over or move during use.

Formed within the top surface 22 is an elongated, open ended, constant width channel 32. Formed within the channel 32 are a plurality of sawteeth 34. Sawteeth 34 is divided into a series of groups with a cavity 31 dividing each directly adjacent groups of sawteeth 34.

Formed within the bottom surface 24 is an elongated deep cavity 38. Within the cavity 38 is formed an elongated plateau 40 which extends the entire length of the cavity 38. The exterior surface of the plateau 40 includes a plurality of spaced apart projections 42. In referring to FIG. 4, another elongated member 20 can be placed in a stacked relationship with an elongated member 20. The top surface 22 is located within the elongated cavity 38 and a projection 42 will rest within a cavity 34 to prevent longitudinal sliding movement of the elongated member 20 that is stacked on top of the other elongated member 20.

Figure 4:
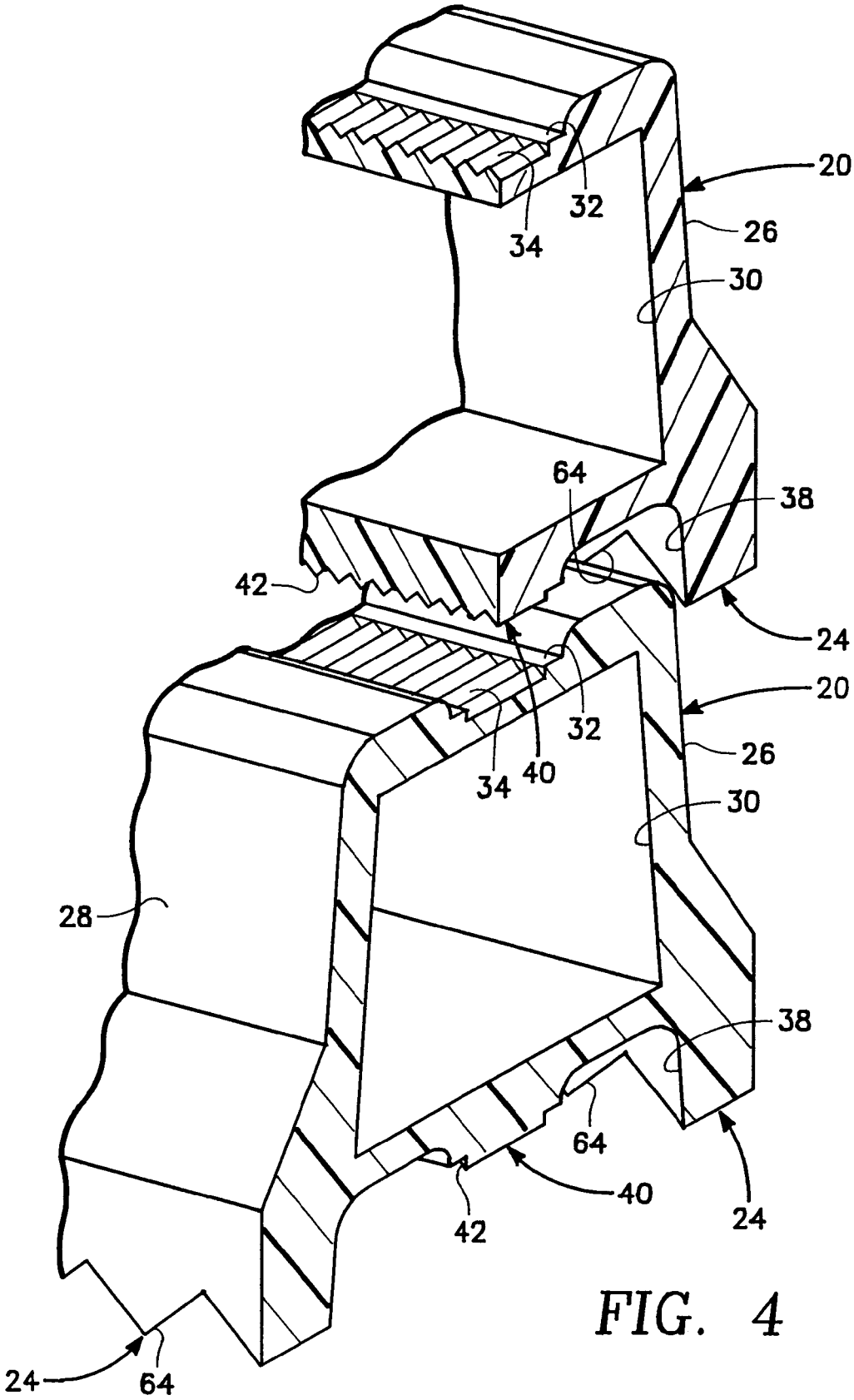
FIG. 4 is an enlarged, transverse, isometric view of a first elongated member of the skateboard rail of the present invention taken along line 4—4 of FIG. 3 showing the addition of a second elongated member about to be located in a stacked relationship with the first elongated member.
Figure 5:
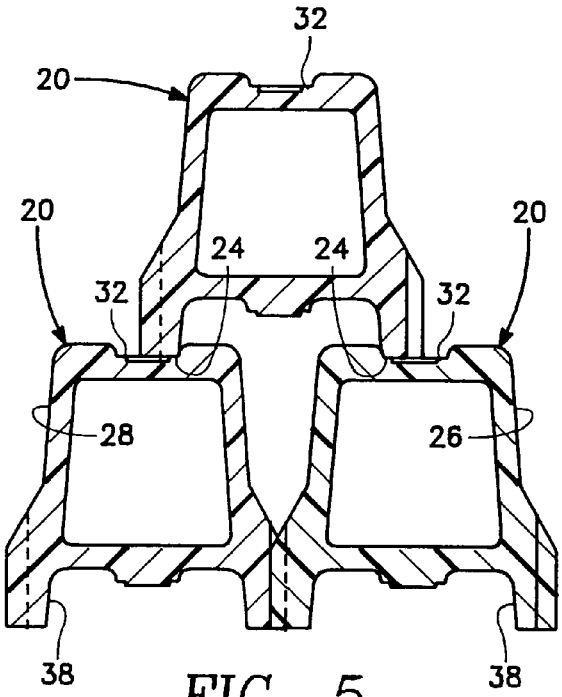
FIG. 5 is a transverse cross-sectional view showing three of the elongated members in a stacked relationship.
Figure 5A:
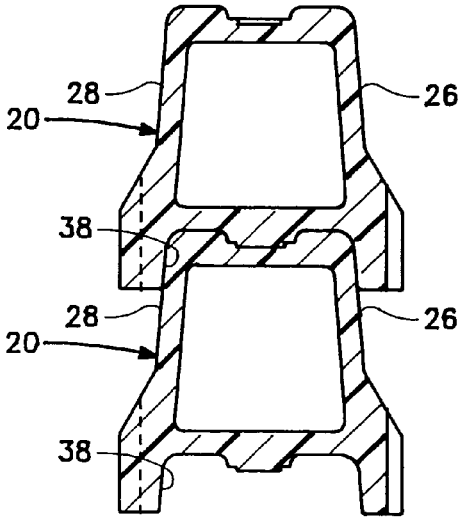
FIG. 5A shows a pair of the elongated members stacked in an aligned manner.
Figure 6:
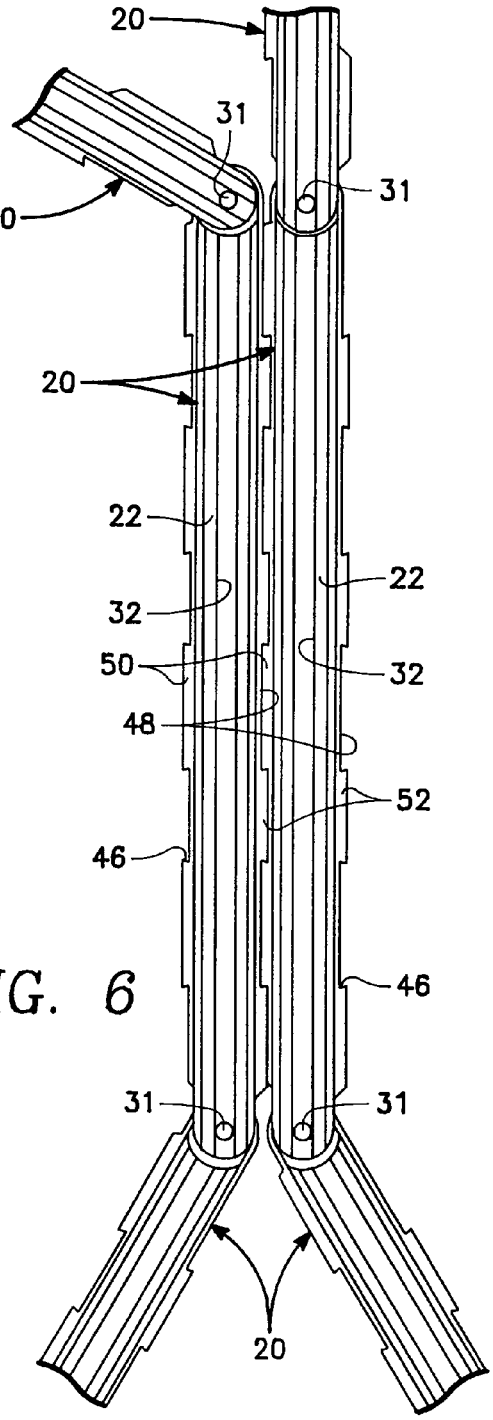
FIG. 6 is a top plan view showing two sets of three elongated members each which are mounted in a side-by-side connecting arrangement and showing how the elongated members in each set can be moved to occupy different positions.
Figure 8:
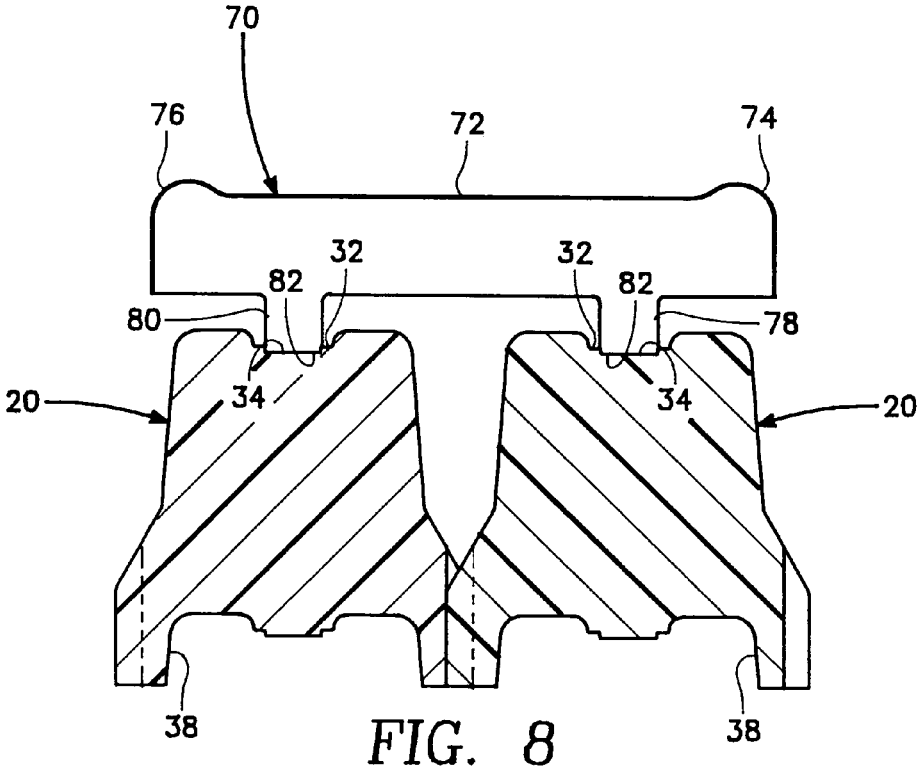
FIG. 8 is a cross-sectional view showing two elongated members of the skateboard rail of the present invention shown connected together and with the table of FIG. 7 mounted thereon.

The right side 26 includes a series of spaced apart dovetail slots 46. The left side 28 includes a series of spaced apart dovetail slots 48. In between each directly adjacent pair of the dovetail slots 46 is located a dovetail protuberance 50. In between each directly adjacent pair of the slots 48 is a protuberance 52. The skateboard rail of the present invention can be constructed, as shown in FIGS. 5, 6 and 8, to be interlocked together side-by-side with each protuberance 50 being located within a slot 48, and each protuberance 52 located within a slot 46. It is to be understood that as many of the elongated members 20 could be arranged in a side-by-side manner as the user would wish to connect together. In FIG. 5, a first row of sawteeth 64 of the elongated member 20 that is located on top of the stack will engage with sawteeth 34 of a lower elongated member 20 and a second row of sawteeth 64 will engage with sawteeth 34 of the remaining lower elongated member 20. Also, two or more of the elongated members 20 could be stacked directly aligned, as shown in FIG. 5A, when stacked in this manner, as is also shown in FIG. 4, the first row of sawteeth 64 is located against right side 26 and the second row of sawteeth 64 is located against left side 28. Each projection 42 will rest within a cavity 34. In between each directly adjacent pair of projections 42 is a group of the sawteeth 34.

Each elongated member 20 has a front end 54 and a rear end 56. The front end 54 includes a pin 58. The rear end 56 includes a hole 60. The front end 54 is shown to have a rounded configuration as does also the rear end 56. The rear end 56 is formed into a thin flange shape. The main body of the elongated member 20, which is located directly adjacent the rear end 56, is formed into a curved wall 62. A pin 58 of one elongated member 20 can be mounted in conjunction with a hole 60 and then that particular elongated member can be moved relative to the other elongated member 20 to which it is connected. This movement is such so that one elongated member 20 can be arranged at an angular displacement relative to the other elongated member to which it is connected. This type of connecting arrangement is shown in FIG. 6.

Figures 13, 14:
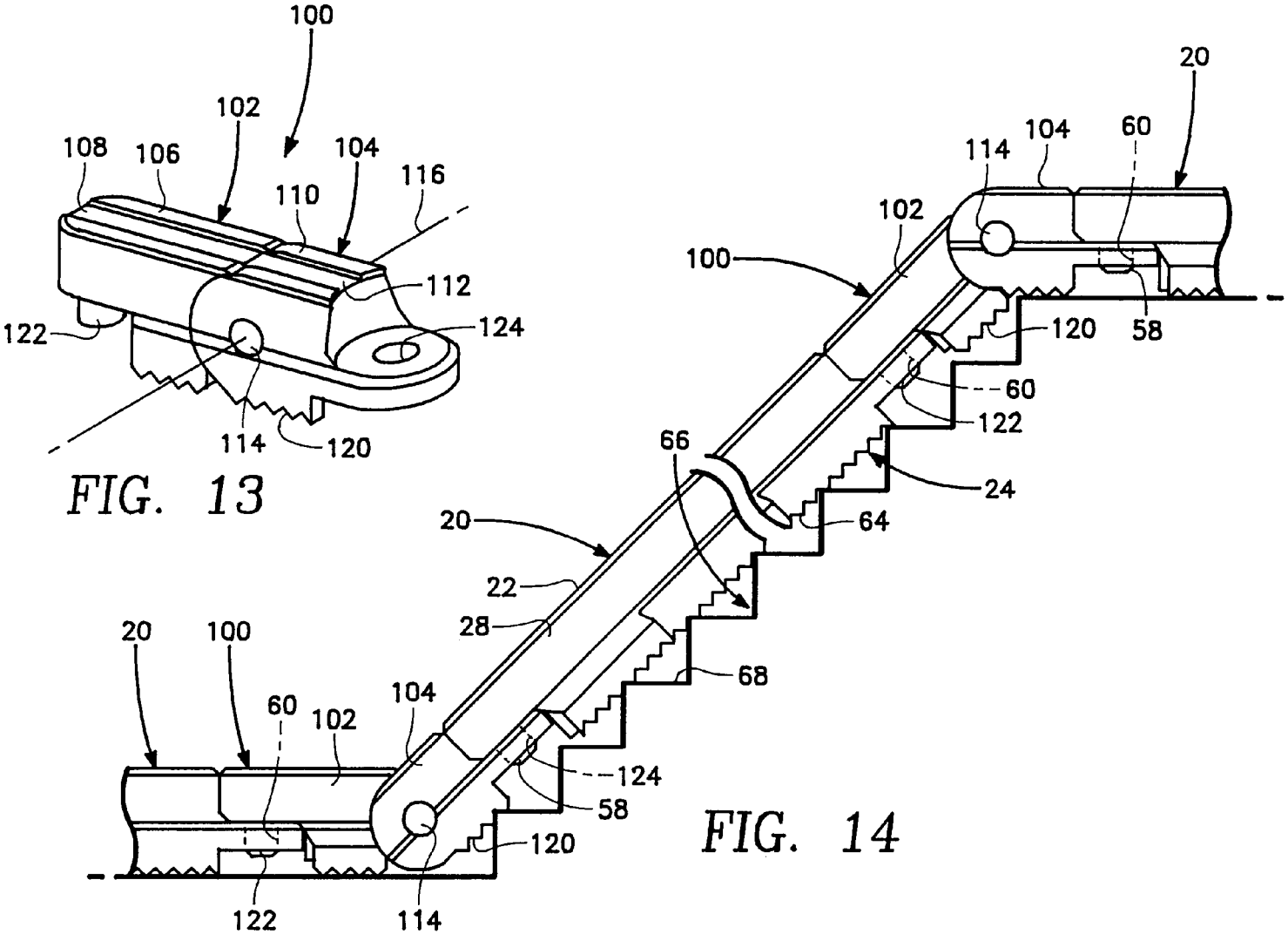
FIG. 13 is an isometric view of a connector that is usable to connect between a pair of elongated members of the skateboard rail of the present invention.
FIG. 14 is a side elevational view showing the skateboard rail of the present invention having one of the connectors of FIG. 13 mounted at one end of the skateboard rail and another of the connectors of FIG. 13 mounted at the opposite end of the skateboard rail.

The bottom surface 24 also includes a series of serrations formed by two rows of sawteeth 64 all along the bottom surface 24 with the exception of being located within the cavity 38. One reason for the sawteeth 64 is that when the elongated members 20 are placed on certain supporting surfaces 66, which is shown in FIG. 14 to comprise a stair 68, the sawteeth 64 facilitates grabbing onto and holding tightly onto the stair 68. When utilizing of the elongated members 20 on certain supporting surfaces, such as a stair 68, it is desirable to have the elongated member 20 to be maintained in its established position and not slide relative to the stair 68. The sawteeth 64 also engage with sawteeth 34 when the members 20 are stacked in a laterally staggered relationship to prevent movement between members 20.

Figure 7:
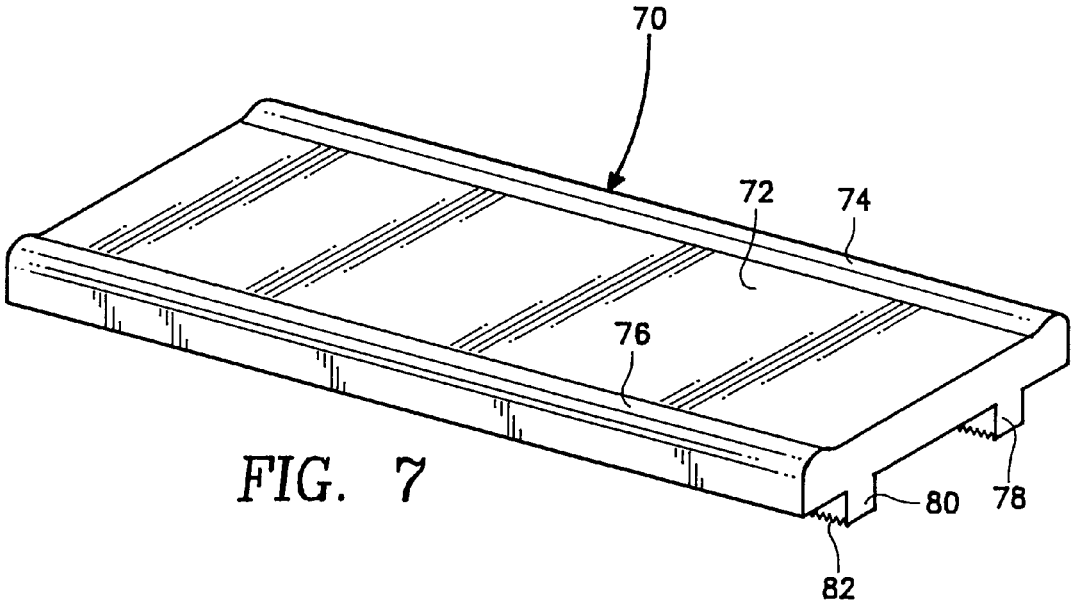
FIG. 7 is an isometric view of the table that is utilized in conjunction with the skateboard rail of the present invention.

Referring particularly to FIGS. 7 and 8 of the drawings, there is shown a table 70 which has an upper flat surface 72 which has a coping bump 74 and 76 located at each side edge. The coping bumps 74 and 76 extend the entire length of the table 70. The undersurface of the table 70 includes a pair of spaced apart plateaus 78 and 80. Each plateau 78 and 80 will include a series of sawteeth 82. The sawteeth 82 will function to engage in an interlocking manner with the sawteeth 34.

The table 70 can be placed on a pair of elongated members 20 that are mounted in a side-by-side manner, as is shown in FIG. 8. The flat surface 72 provides a wider flat surface for riding of the skateboard thereon as opposed to the thin surface that is provided by the top surface 22 of the elongated member 20.

Referring particularly to FIGS. 9 and 10 of the drawings, there is shown a protective cover 84. This cover 84 is constructed of hard sheet material, metal usually preferred, and it has a basic channel shape forming a pair of spaced apart parallel legs 86 and 88 with an apex section 85 extending therebetween. The space between the legs 86 and 88 is defined as a cavity 90. The top surface 22 of the elongated member 20 is to be located within the cavity 90 in a snug relationship. There will probably be utilized fasteners, such as screws, to securely fasten each of the legs 86 and 88 to the right side 26 and left side 28 of the elongated member 20. The whole purpose for the protective cover 84 is to provide a strong covering material that is wear resistant to the abrasiveness that it will inherently encounter by the constant use of having skateboards slide there across. Instead of the top surface 22 taking the wear, the cover 84 takes the wear, and upon the cover 84 becoming significantly worn or damaged, it can be replaced. Cover 84 has a groove 85 at one end and a tongue 87 at the opposite end. A tongue 87 of one cover 84 can interlock with a groove 85 of another cover 84.

Referring particularly to FIGS. 11 and 12 of the drawings, there is shown a different form of protective cover 92. The cover 92 is defined on its upper surface by a flat, elongated, open ended channel 94 which is formed between each side edge of the cover 92 which is formed into coping bumps 96 and 98. The free edges 97 and 99, respectively, of each of the coping bumps 96 and 98 are to abut against their respective side edges 26 and 28 of the elongated member 20. The side edges 26 and 28 may include elongated grooves so that the side edges of the coping bumps 96 and 98 can merely slip within those grooves, which are not shown. The same is true for FIG. 9. The main distinction of the protective cover 92 is that it provides a little different surface that when maneuvering the skateboard across the protective cover 92 as opposed to when utilizing the protective cover 84. Cover 92 has a groove 91 at one end (similar to groove 85) and a tongue 93 at the opposite end (similar to tongue 87). The coping bumps 96 and 98 provide a greater degree of control.

Referring particularly to FIG. 13, there is shown a connector 100. The connector 100 is formed of a male part 102 and a female part 104. The male part 102 has a top surface 106 which has a longitudinal open ended channel 108. The female part 104 has a similar top surface 110 which also includes a longitudinal open ended channel 112. The male part 102 and the female part 104 are connected together by a pivot pin 114 which produces a pivot axis 116. It is to be noted that this pivot axis 116, when used in conjunction with elongated member 20, will be located transverse or at a right angle to the longitudinal axis 118 of the elongated member 20. The bottom surface of both the male part 102 and the female part 104 is formed into a sawtooth edge 120. The function of the sawtooth edge 120 is for the same purpose as the sawteeth 64. The male part 102 includes a pin 122 and the female part 104 includes a hole 124.

The connector 100 can be utilized to connect two of the elongated members 20 together. When so connected, the elongated members 20 can be located at various angularly spaced relationships. For example, noting particularly FIG. 14, it can thus be seen that with the pin 122 being mounted within a hole 60 of the elongated member 20, and with a pin 58 of the elongated member 20 mounted within a hole 124 of the connector 100, and with the pin 122 being mounted within a hole 60 of the elongated member 20, that one elongated member 20 can be displaced at any angular relationship relative to the other elongated member 20 by merely pivoting about the pivot axis 116 by means of the pivot pin 114. The channels 108 and 112 in essence match up with the channel 32 in the elongated member 20. As a result, the skateboarder can use the connectors 100 to form different configurations of an edge on which to ride the skateboard. For example, in FIG. 14 the skateboard can traverse in a horizontal manner and then down a vertical manner along the stair 68 and then back into a horizontal manner.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A skateboard rail comprising:

a plurality of members which are connected together by connecting means in an end-to-end relationship where each member of said members is elongated having a longitudinal axis;

each member has a top surface and a bottom surface which is connected together by sides forming a general polygonal configuration in transverse cross-section; and said top surface including an elongated shallow channel, said elongated shallow channel adapted to engage with a leg of a separate table which is to be mounted within said channel.

2. A skateboard rail comprising:

a plurality of members which are connected together by connecting means in an end-to-end relationship where each member of said members is elongated having a longitudinal axis;

each member has a top surface and a bottom surface which is connected together by sides forming a general polygonal configuration in transverse cross-section; and said bottom surface having an elongated deep cavity that permits insertion of a said top surface of another said channel in an interlocked relationship forming a stack of said members.

3. The skateboard rail as defined in claim 2 wherein:

with said members in said stack said members being longitudinally locked together by a plurality of protrusions that engage with a plurality of grooves which prevent longitudinal relative movement between said members.

4. A skateboard rail segment comprising:

an elongated member having a top surface and a bottom surface which are connected together by opposing sides, said elongated member terminating in a pair of ends defined as a front end and a rear end, said front end having a first connecting means, said rear end having a second connecting means;

whereby said bottom surface of said elongated member is to be placed on a supporting surface so a skateboarder can hop onto said elongated member and slide by the skateboard along said top surface; and said top surface having an elongated shallow channel, said elongated shallow channel adapted to engage with a leg of a separate table which is to be mounted within said channel.

5. The skateboard rail segment as defined in claim 4 wherein:

said elongated shallow channel having a first engagement means, said elongated deep cavity having a second engagement means, said second engagement means of one said elongated member being capable of connecting with a first engagement means of another said elongated member.

6. The skateboard rail segment as defined in claim 5 wherein:

said first engagement means comprising a plurality of spaced apart cavities.

7. The skateboard rail segment as defined in claim 6 wherein:

said second engagement means comprising a plurality of spaced apart projections which are adapted to interlock with said cavities.

8. A skateboard rail segment comprising:

an elongated member having a top surface and a bottom surface which are connected together by opposing sides, said elongated member terminating in a pair of ends defined as a front end and a rear end, said front end having a first connecting means, said rear end having a second connecting means;

whereby said bottom surface of said elongated member is to be placed on a supporting surface so a skateboarder can hop onto said elongated member and slide by the skateboard along said top surface; and said bottom surface having an elongated deep cavity, said elongated deep cavity adapted to interlock with a top surface of another said member thereby forming a stack of members.

9. A skateboard rail segment comprising:

an elongated member having a top surface and a bottom surface which are connected together by opposing sides, said elongated member terminating in a pair of ends defined as a front end and a rear end, said front end having a first connecting means, said rear end having a second connecting means;

whereby said bottom surface of said elongated member is to be placed on a supporting surface so a skateboarder can hop onto said elongated member and slide by the skateboard along said top surface; and said bottom surface being wider than said top surface.

10. A skateboard rail segment comprising:

an elongated member having a top surface and a bottom surface which are connected together by opposing sides, said elongated member terminating in a pair of ends defined as a front end and a rear end, said front end having a first connecting means, said rear end having a second connecting means;

whereby said bottom surface of said elongated member is to be placed on a supporting surface so a skateboarder can hop onto said elongated member and slide by the skateboard alone said top surface; and a protective cover attachable onto said elongated member covering said top surface, whereby said protective cover to provide a replaceable wearing surface that will prevent wear from occurring on said top surface of said elongated member.

11. The skateboard rail segment as defined in claim 10 wherein:

said protective cover including a coping bump located at each side of said cover.

12. A skateboard rail segment comprising:

an elongated member having a top surface and a bottom surface which are connected together by opposing sides, said elongated member terminating in a pair of ends defined as a front end and a rear end, said front end having a first connecting means, said rear end having a second connecting means;

whereby said bottom surface of said elongated member is to be placed on a supporting surface so a skateboarder can hop onto said elongated member and slide by the skateboard along said top surface; and said bottom surface including a series of sawteeth to provide a roughened surface tending to prevent slippage of said elongated member when placed on a supporting surface.

* * * * *